US005514293A

United States Patent [19]

Shimakura et al.

[11] Patent Number: 5,514,293

[45] Date of Patent: May 7, 1996

[54] ACIDIC CLEANING AQUEOUS SOLUTION FOR ALUMINUM AND ALUMINUM ALLOY AND PROCESS FOR CLEANING THE SAME

[75] Inventors: Toshiaki Shimakura, Neyagawa; Takeyasu Ito, Chiba; Yuichi Yoshida, Yawata; Masayuki Kamimura, Ichikawa; Satoshi Ikeda, Yamato; Miyuki Shimada, Osaka, all of Japan

[73] Assignee: Nippon Paint Co., Ltd., Osaka, Japan

[21] Appl. No.: 219,283

[22] Filed: Mar. 28, 1994

[30] Foreign Application Priority Data

| | | | |
|---|---|---|---|
| Mar. 26, 1993 | [JP] | Japan | 5-067748 |
| Jul. 26, 1993 | [JP] | Japan | 5-183659 |
| Jul. 30, 1993 | [JP] | Japan | 5-189641 |
| Aug. 24, 1993 | [JP] | Japan | 5-209266 |
| Feb. 15, 1994 | [JP] | Japan | 6-018096 |

[51] Int. Cl.[6] ..... C09K 13/06

[52] U.S. Cl. ..... 252/79.2; 252/79.1; 216/102

[58] Field of Search ..... 156/664, 665; 252/79.4, 79.1, 79.2; 216/102

[56] References Cited

U.S. PATENT DOCUMENTS

| | | | |
|---|---|---|---|
| 2,477,181 | 7/1949 | Holman | 252/136 |
| 3,607,484 | 9/1971 | Marakawa et al. | 156/22 |
| 3,663,441 | 5/1972 | Gulla | 252/79.4 |
| 3,869,303 | 3/1975 | Orlor et al. | 117/47 A |
| 4,728,456 | 3/1988 | Yamasoe et al. | 252/142 |
| 4,851,148 | 7/1989 | Yamasoe et al. | 252/142 |
| 4,883,541 | 11/1989 | Tadros | 134/3 |

FOREIGN PATENT DOCUMENTS

| | | | |
|---|---|---|---|
| 0196668 | 10/1986 | European Pat. Off. . | |
| 1814074 | 7/1969 | Germany . | |
| 4100839 | 7/1992 | Germany . | |
| 57-089480 | 6/1982 | Japan . | |
| 57-165904 | 10/1982 | Japan . | |
| 1148132 | 3/1985 | U.S.S.R. . | |
| 1468971 | 3/1989 | U.S.S.R. . | |
| WO9008205 | 7/1990 | WIPO . | |
| WO9119830 | 12/1991 | WIPO . | |
| WO9301332 | 1/1993 | WIPO | C23G 1/12 |

OTHER PUBLICATIONS

"Effect of Additives of Potassium Habides On The Dimensional Etching of Copper In Chromic Acid Solutions"; Shmeliy et al.; 1980; abstract only; Zh Prikl, Khim, 53(7). Dialogue Information Services Abstract for Japanese Patent Application No. 72039823.

*Primary Examiner*—R. Bruce Breneman
*Assistant Examiner*—George Goudreau
*Attorney, Agent, or Firm*—Sughrue, Mion, Zinn, Macpeak & Seas

[57] ABSTRACT

Disclosed is an acidic cleaning aqueous solution for aluminum and aluminum alloy and a process for cleaning the same, intended to execute acidic cleaning without using harmful fluoride and chloride ions.

The oxidation-reduction potential of a cleaning bath is controlled to be at 0.5 to 0.8 V (vs. Ag-AgCl). The cleaning bath is obtained by diluting an acidic cleaning aqueous solution for aluminum and aluminum alloy to a predetermined volume. The acidic cleaning aqueous solution contains specified amounts of at least one of inorganic acids, $Br^-$ ions and oxidized metal ions, with the addition of a surfactant and oxidizing agent if necessary.

It is thus possible to present a uniform etching effect irrespective of low temperature (below 60° C.) without containing fluoride ions and chromic ions within the acidic cleaning aqueous solution. $Br^-$ also has an effect of inhibiting the oxidation-decomposition reaction of the surfactant arising from the oxidizing agent and oxidized metal ions, thereby obtaining a long-life acidic cleaning aqueous solution.

30 Claims, No Drawings

ACIDIC CLEANING AQUEOUS SOLUTION FOR ALUMINUM AND ALUMINUM ALLOY AND PROCESS FOR CLEANING THE SAME

BACKGROUND OF THE INVENTION

1. Field of the Invention

The present invention relates to an acidic cleaning aqueous solution for aluminum and aluminum alloy and a process for cleaning the same, and more particularly to a cleaning aqueous solution and the cleaning process capable of satisfactorily removing lubricant oil and aluminum powder adhering on aluminum surfaces due to fabrication.

2. Description of the Related Art

Aluminum articles such as beverage containers made of aluminum or aluminum alloy, are customarily manufactured by a metal-forming operation called "drawing and ironing" (hereinafter referred to as DI processing). In the course of this and similar metal-forming operations a lubricant oil is applied to the surface of the metal being deformed, and some abraded aluminum particles and other contaminates (usually referred to as "smut") adhere to the metal surface, especially to the inner walls of such beverage containers. The surfaces of such types of containers are protected by subsequent chemical-conversion coating and/or paint coating techniques. Therefore, the above-mentioned lubricant oil or smut must be removed, by cleaning, from the metal surfaces before the chemical-conversion coating.

This surface cleaning is normally applied by means of an acidic cleaning agent which appropriately etches the metal surfaces. Till now the acidic cleaning agents used for smut-removal have generally been ones containing chromic acid or hydrofluoric acid. Especially, the cleaning agent containing the hydrofluoric acid is superior in enabling the low-temperature acidic cleaning (up to 50° C.). However, the chromic acid and hydrofluoric acid are harmful substances, and hence control of their liquid waste is strict. Thus, demanded in recent years is an establishment of chromium-free or fluorine-free low-temperature acidic cleaning techniques.

Such chromium-free or fluorine-free acidic cleaning techniques are proposed in U.S. Pat. No. 4728456 titled "Aluminum surface cleaning agent", U.S. Pat. No. 4851148 titled "Method of controlling an aluminum surface cleaning composition", and WO 9301332-A1 titled "Method and acidic composition for cleaning aluminum".

In U.S. Pat. Nos. 4728456 and 4851148, respectively, titled "Aluminum surface cleaning agent" and "Method of controlling an aluminum surface cleaning composition", disclosed are a cleaning agent including an acidic cleaning agent of pH 2 or below prepared from sulfuric acid and nitric acid containing little or no fluoric ions with the addition of ferric ions serving an accelerator instead of fluoride ions, and a method for controlling the oxidation-reduction potential of the cleaning bath to control the ferric ion concentration in the bath, respectively.

Also, in WO 9301332-A1 titled "Method and acidic composition for cleaning aluminum", disclosed are an acidic cleaning solution containing sulfuric acid and/or nitric acid and ferric ions serving as an accelerator for etching instead of fluoride ions, and further containing oxidized ion of diphenylamine having color-change potential (that is, at a transition of a certain potential, color becomes transparent) in the vicinity of standard oxidation-reduction potential (+0.77 *±0.09 V) where ferric ions ($Fe^{3+}$) are changed into ferrous ions ($Fe^{2+}$), oxidized ions of diphenylbenzidine and oxidized ions of sulfonic diphenylamine, and the cleaning process for controlling the ferric ion concentration by controlling the color-change point.

In U.S. Pat. No. 3607484 titled "Etching aluminum", disclosed is a corrosion liquid consisting of sulfuric acid aqueous solution with the addition of metals (ions of Cu, Fe, Ni, Co, Sn, Zn, etc.) having a smaller ionization tendency than aluminum and 7 g ion/l of at least one selected from halogen ions (F, Br, I) besides Cl, $PO_4^{3-}$, pyrophosphoric ion, pentaphosphoric ion and so on.

In Japanese Patent Publication No. 47-39823 titled "Aluminum and aluminum alloy corrosion liquid", disclosed is a corrosion liquid containing 0.1 to 7.0 g ion/l of at least one of $Cl^-$, $F^-$, $Br^-$, $I^-$, phosphoric ion, pyrophosphoric ion, pentaphosphoric ion and so on.

Ordinarily, the etching reaction of aluminum within the acidic cleaning solution includes an anode reaction in which aluminum is changed into aluminum ions ($Al^{3+}$) and a cathode reaction in which $H^+$ in the cleaning solution is reduced into ½ $H_2$. Thus, the addition of ferric ions ($Fe^{3+}$) into the acidic cleaning solution simultaneously causes a cathode action for reducing $Fe^{3+}$ into $Fe^{2+}$ and the reduction of $H^+$, which accelerates the etching reaction of aluminum.

Further, the oxidizing agent is used to control the oxidation-reduction potential to control the ferric ion concentration within the bath, thereby suppressing the $Fe^{2+}$ concentration which increases accordingly as the etching reaction advances and oxidizing the $Fe^{2+}$ into $Fe^{3+}$.

It is however known that the oxidizing agent typically acts to oxidize and decompose the surfactant. Therefore, the addition of an oxidizing agent into an acidic cleaning aqueous solution containing a surfactant for improving the degreasing ability may cause accumulation of oxidized decomposed substance within the cleaning bath, which will lead to a reduction in the degreasing ability on the aluminum surfaces. On the contrary, the addition of excessive oxidizing agent in order to maintain the degreasing ability will increase the operating cost.

In WO 91 19830-A1 there is proposed is an "acidic liquid composition and process for cleaning aluminum" containing a mineral acid selected from the group of phosphoric acid, sulfuric acid, and nitric acid, multiply charged metallic ions, surfactant, and oxidizing agent for oxidizing the multiply charged metallic ions which were reduced during the cleaning operation, with the addition of 0.05 to 5 g/l of a $C_2$ to C10 glycol for suppressing the decomposing reaction of surfactant due to the oxidizing agent.

In the case of using the acidic cleaning agent disclosed in U.S. Pat. Nos. 4728456 and 4851148, however, the treatment must be made at a higher temperature (70° to 80° C.) than the temperature (up to 50° C.) of acidic cleaning by means of acidic cleaning agent containing fluoride ions in order to obtain the same effect as the acidic cleaning by the acidic cleaning agent containing fluoric ions, which will be economically disadvantageous. Since a multiplicity of $Fe^{3+}$ ions are contained, a precipitation derived from ferric ions is produced, and in particular, iron hydroxide which is in the form of a precipitate may adhere to the heater section. Also, in the case of WO 9301332-A1, it is necessary to perform acidic cleaning at high temperature, which will be economically disadvantageous.

The corrosion liquid disclosed in U.S. Pat. No. 3607484 and Japanese Patent Publication No. 47-39823 mainly aims to etch the aluminum alloy by electrodeposition in order to form a photoengraving. In the case of coexisting with the copper ion, as disclosed by U.S. Pat. No. 3607484, the oxidation-reduction potential is over 1.08 V in the etching treatment. Therefore, the use of Br ions as halogen ions besides Cl would lead to the reaction. $2Br^- \rightarrow Br_2+2e$, which leads to the production of harmful bromine gas. Thus, exclusive treatment facility must be provided, which will be economically disadvantageous. In addition, these corrosion liquids contain 56 g/l or more of bromide ions for its object in the examples, which is different in the object of etching from the present invention.

In the acidic cleaning aqueous solution disclosed in WO 9119830-A1, the content of a $C_2$ to $C_{10}$ glycol for the suppression of decomposition reaction of surfactant by the oxidizing agent is 0.05 to 5 g/l (namely, 50 to 5000 ppm) within the acidic cleaning aqueous solution, and hence the glycol compounds do not solely have the etching accelerating effect. Reversely, a large volume of addition will increase the effective ingredients, which will increase the load of liquid waste treatment.

The present invention was conceived in view of the above conventional problems, of which an object is to provide an acidic cleaning aqueous solution for aluminum and aluminum alloy and its cleaning process, enabling cleaning not only at high temperature but also at lower temperature, without including harmful fluoride and chromic ions.

DESCRIPTION OF THE INVENTION

The present invention provides an acidic cleaning aqueous solution for aluminum and aluminum alloy containing 0.5 to 25 g/l of at least one inorganic acid, 0.002 to 5 g/l of bromide ions, and 0.05 to 4 g/l of oxidized metal ions.

The above acidic cleaning aqueous solution for aluminum and aluminum alloy further including 0.1 to 10 g/l of surfactant is provided.

Any one of the above acidic cleaning aqueous solutions for aluminum and aluminum alloy further including an oxidizing agent is provided.

The present invention provides an acidic cleaning aqueous solution for aluminum and aluminum alloy containing 0.5 to 25 g/l of at least one inorganic acid, 0.1 to 5 g/l of bromide ions, and 0.1 to 10 g/l of nonionic surfactant.

Further provided is another acidic cleaning aqueous solution for aluminum and aluminum alloy containing 10 to 20 g/l of inorganic acid mixture of an sulfuric acid and nitric acid whose mixture weight ratio sulfuric acid/nitric acidic is 30/1 to 30/4, 0.8 to 2.5 g/l of bromide ions, and 1 to 5 g/l of nonionic surfactant.

The present invention also provides a process for cleaning aluminum and aluminum alloy surfaces in which the oxidation-reduction potential of an acidic cleaning aqueous solution for aluminum and aluminum alloy is 0.5 to 0.8 V at silver-silver chloride electrode potential reference, the acidic cleaning aqueous solution containing 0.5 to 25 g/l of at least one inorganic acid, 0.002 to 5 g/l of bromide ions, 0.05 to 4 g/l of oxidized metal ions, and 0.1 to 10 g/l of surfactant and/or oxidizing agent in conformity with degreasing requirements.

Further provided is a process for cleaning aluminum and aluminum alloy surfaces in which an acidic cleaning aqueous solution is used containing 0.5 to 25 g/l of at least one inorganic acid, 0.002 to 5 g/l of bromide ions, 0.05 to 4 g/l of oxidized metal ions, and 0.1 to 10 g/l of surfactant and/or oxidizing agent in conformity with degreasing requirements, and in which "oxidized metal ions and an oxidizing agent" or "an oxidizing agent" are supplied within the acidic cleaning aqueous solution, and in which the oxidized metal ion concentration is so controlled that the oxidation-reduction potential of the aqueous solution is 0.5 to 0.8V at a silver-silver chloride electrode potential reference.

Bromide ions contained within the acidic cleaning aqueous solution for aluminum and aluminum alloy ensure the following two features. A first feature is to serve as an etching accelerating agent, and a second feature is to act as an oxidation-decomposition reaction inhibiting agent for surfactant.

The above-mentioned acidic cleaning aqueous solution is used as a cleaning bath for cleaning the material of aluminum and aluminum alloy, which is obtained by diluting a thick aqueous solution of the above acidic cleaning aqueous solution with an appropriate amount of water into a concentration lying within the use range. Description will now be made based on the cleaning bath.

Inorganic acids can be sulfuric acid, nitric acid, and phosphoric acid.

Aluminum is typically liable to form a stable oxide layer on its surface. Fluoride ions which have been hitherto added decreased anode/cathode polarizations of aluminum within the acidic bath, and presented a satisfactory etching effect at lower temperature by increasing the corrosion current density. Thus, the first feature of the present invention is to enable the aluminum and aluminum alloy to be cleaned at not only high temperature but also low temperature (35° to 60° C.) by the use of both a so-called "anode depolarizer" for decreasing the anode polarization and a so-called "cathode depolarizer" for decreasing the cathode polarization without using fluoride ions. A specific "anode depolarizer" is bromide ions ($Br^-$) acting as an etching accelerator. This is due to the fact that a "cathode depolarizer" does not solely ensure a satisfactory etching effect at lower temperature (35° to 60° C.).

When using bromide ions ($Br^-$) together with a "cathode depolarizer", generation of pits on the aluminum surfaces was not observed at all, and an appropriate etching effect was obtained. On the contrary, when using chloride ions together with a "cathode depolarizer", its etching accelerating effect was highest after fluoride ions, but a multiplicity of pits were disadvantageously produced. In the case of using iodide ions ($I^-$) together with a "cathode depolarizer", no etching accelerating effect was observed, and the cleaning power was poor. In the manufacturing line of aluminum cans, the cleaning steps are executed with the aluminum cans mounted on a stainless steel conveyer. It is therefore necessary to perform a uniform etching at the contact with the stainless steel without producing any pits. Bromide ions are superior in this respect.

A supply source for bromide ions can be an HBr aqueous solution, potassium bromide, sodium bromide, aluminum bromide, and iron bromide. As a "cathode depolarizer", generally used are oxidized metal ions. The oxidized metal ions can be ferric ions ($Fe^{+3}$), metavanadic ions ($VO_3^-$), and cerimetric ions ($Ce^{4+}$). Bromide ions of the above-mentioned "anode depolarizer", if they coexist with a strong oxidizing agent, cause the reaction $2Br^- \rightarrow Br_2+2e$, which may bring about harmful bromine gas ($Br_2$). Since the oxidation-reduction equilibrium potential is 1.08 V at that time, it is preferred to use oxidized metal ions having an oxidation-reduction equilibrium potential lower than 1.08 V, that is, ferric ions ($Fe^{+3}$) or metavanadic ions ($VO_3^-$). The coexistence of ferric ions and bromide ions does not cause any liberation of bromine gas.

A supply source for ferric ions can be a water-soluble ferric salt such as ferric sulfate, ferric nitrate, or ferric perchlorate. A supply source for metavanadic ions can be sodium metavanadate, potassium metavanadate, ammonium metavanadate, and so on. A supply source for cerimetric ions can be ammonium cerium sulfate.

As surfactants one can use available are nonionic, cationic, anionic, or amphoteric ionic surfactants in the conventional manner. Among them, particularly preferable is a nonionic surfactant, for example, ethoxylated alkylphenol, hydrogencarbonate derivative, abietic acid derivative, primary ethoxylated alchohol, or modified polyethoxylated alchohol. As the above nonionic surfactant preferable is a nonionic surfactant having an HLB (hydrophile-lipophile balance) of 5 to 15, and more preferable is to use both a nonionic surfactant of an HLB of 6 to 8 and a nonionic surfactant of HLB 12 to 14. The use of such nonionic surfactants having different HLB values ensures a good balance between the cleaning power and anti-foaming power. The mixing ratio of the nonionic surfactant having different HLB values is preferably [nonionic surfactant of HLB 6 to 8] / [nonionic surfactant of HLB 12 to 14]=1/5 to 5/1, and more preferably [nonionic surfactant of HLB 6 to 8] / [nonionic surfactant of HLB 12 to 14] it is 1/2to 2/1. If the HLB is less than 5, it is difficult for the surfactant to disperse into water, and the cleaning aqueous solution is liable to become unstable. On the contrary, if the HLB is more than 15, a large difference in cleaning power was not seen, but reversely the foaming ability was increased, which may lead to a reduction in workability.

It is to be noted that HLB in the present invention is Griffin's HLB and is a numerical value indicating the hydrophilicity of the surfactant. HLB can be expressed as follows:

HLB=(molecular weight of hydrophilic group / molecular weight of surfactant)×(100/5)

={weight of hydrophilic group / (hydrophobic group+ hydrophilic group)}×(100/5)

In the absence of a hydrophilic group, HLB=0.

0.1 to 10 g/l of nonionic surfactant is preferably contained within a cleaning aqueous solution, and a more preferable content is 1 to 5 g/l. In the case where the content of the nonionic surfactant within the cleaning aqueous solution is less than 0.1 g/l, the cleaning power is liable to be lowered. On the contrary, in the case where the content was more than 10 g/l, the difference in cleaning power was not seen, and the load of waste water treatment tends to be heightened.

When performing cleaning, in the case of using ferric ions as oxidized metal ions for cleaning, the ferric ions are usually changed into ferrous ions with the lapse of time based on $Fe^{3+}+e \rightarrow Fe^{2+}$, and the oxidation-reduction potential is lowered (called also aging of the cleaning bath), which results in no etching accelerating effects on the aluminum surfaces. Also in the case of oxidized metal ions other than the ferric ions, the cleaning bath is similarly aged with the lapse of time. Thus, by appropriately adding an oxidizing agent for controlling ORP or alternatively by initially adding the oxidizing agent for controlling ORP into the acidic cleaning aqueous solution, the ferrous ions may be oxidized into ferric ions. The oxidizing agent for the control of ORP oxidation-reduction potential can be hydrogen peroxide ($H_2O_2$), a persulfate (for example, $NAS_2O_8^{2-}$), ozone ($O_3$), a cerium compound (for example, ammonium cerium sulfate: $(NH_4)_4Ce(SO_4)_4$), and a nitrite (for example, $NANO_2$, $KNO_2$). Such an oxidizing agent is disclosed in U.S. Pat. No. 4851148. On the other hand, in the case of using metavanadic ions as oxidized metal ions, metavanadic acidic salt may be appropriately supplied.

It is also effective to add the combination of the above oxidizing agent and the above oxidized metal ions into the acidic cleaning aqueous solution upon controlling the ORP.

The second feature of the present invention is that the additive for inhibiting the oxidation-decomposition reaction of the surfactant arising from the above oxidized metal ions and oxidizing agent in the acidic cleaning aqueous solution is bromide ions ($Br^-$).

Although chloride ions ($Cl^-$) can be used as an additives in order to inhibit the oxidation-decomposition reaction, they have a poor effect compared with bromide ions ($Br^-$). Furthermore, as described above, chloride ions may cause a multiplicity of pits on the aluminum surfaces. For this reason, chloride ions ($Cl^-$) are unsuitable as the additives for inhibiting the oxidation-decomposition reaction of the surfactant.

The content of at least one acid inorganic acid of the present invention contained within the cleaning aqueous solution is 0.5 to 25 g/l. The content is preferably 10 to 25 g/l, and more preferably 10 to 20 g/l. If the content of the inorganic acid within the cleaning aqueous solution is less than 0.5 g/l, the etching rate is lowered extremely, which prevents effectiveness as a cleaning bath from being exhibited. On the contrary, if the content is more than 25g/l, the etching is not more effective, which is uneconomical.

The acidic cleaning aqueous solution is preferably regulated to be less than $pH_2$ by at least one acid selected from the inorganic acids of the present invention, more preferably pH 0.6 to 2. If pH is larger than 2, the etching rate on the aluminum surfaces is lowered extremely, and it is difficult to exhibit effectiveness as a cleaning bath.

In the case of using an inorganic acid mixture of sulfuric acid and nitric acidic as the inorganic acid, 0.5 to 25 g/l of an inorganic acid mixture of sulfuric acid and nitric acid is contained within the acidic cleaning aqueous solution. Preferable content is 10 to 20 g/l. The weight ratio of the mixed acid, sulfuric acid/nitric acid is preferably 30/1 to 30/4, and more preferably 30/1 to 30/2. Use of both sulfuric acid and nitric acid can suppress the occurrence of pitting of objects to be treated after cleaning.

The content of oxidized metal ions contained within the acidic cleaning aqueous solution is preferably 0.05 to 4 g/l, and more preferably 0.2 to 2 g/l. In the case where the temperature of the bath lies within the lower temperature region (35° to 60° C.), the content is preferably 0.5 to 4 g/l. On the contrary, when the temperature of the bath lies within the higher temperature region (60° to 80° C.), the content is preferably 0.05 to 4 g/l. If the content of the oxidized metal ions is less than 0.05 g/l, the etching amount is insufficient, which reduces de-smutting ability. On the contrary, if the content is more than 4 g/l, a difference in cleaning power is not observed, and such is uneconomical.

The content of the surfactant contained within the acidic cleaning aqueous solution is preferably 0.1 to 10 g/l, and more preferably 0.5 to 2 g/l. If the content of the surfactant is less than 0.1 g/l, the cleaning power, and in particular, degreasing ability is lowered. On the contrary, if the content is over 10 g/l, a difference in cleaning power is not observed, and the load of waster water treatment is heightened, which is uneconomical.

The content of bromide ions within the acidic cleaning aqueous solution is 0.002 to 5 g/l. In the case where the bromide ions which are the second feature of the present invention serve as an inhibiting agent for the oxidation-decomposition reaction, their content within the acid cleaning aqueous solution is preferably 0.002 to 0.1, and more preferably 0.01 to 0.08 g/l. If the content of the bromide ions is less than 0.002 g/l, the inhibiting effect of the oxidation-decomposition reaction of the surfactant tends to be lowered. Even if it exceeds 0.1 g/l, the inhibiting of the oxidation-decomposition reaction of the surfactant does not become more effective.

Since the oxidation-decomposition reaction of the surfactant is accelerated accordingly as the temperature is raised, the content is preferably 0.002 to 0.03 g/l at lower temperatures (35° to 60° C.) and 0.03 to 0.1 g/ at higher temperatures (60° to 80° C.).

In the case where the bromide ions which are the first feature of the present invention serve as an etching accelerator, the content within the acidic cleaning aqueous solution is 0.5 to 5 g/l at lower temperatures (35° to 60 ° C.) and 0.05 to 0.5 g/l at higher temperatures (60° to 80° C.). A more preferable content is 0.1 to 2.5 g/l when the bath temperature is within the ranges of both the lower temperature (35° to 60° C.) and the higher temperature (60° to 80° C.).

If the content of the bromide ions is less than 0.5 g/l at the lower temperature region, the etching amount is deficient and the de-smutting ability is lowered. On the contrary, even if the content of the bromide ions is less than 0.5 g/l at the higher temperature region, the etching amount is not extremely deficient, and it is possible to lower the content of $Fe^{3+}$ accordingly as the content of the bromide ions is increased, which will lead to the suppression in the generation of precipitation arising from the ferric ions. If the content is over 5 g/l, the etching amount becomes excessive, which will result in the accelerated aging of the treatment bath and non-uniform external appearance and advanced corrosion of equipment.

Preferably, the acidic cleaning bath is controlled to be at an oxidation-reduction potential (ORP) of 0.5 to 0.8 V (vs. Ag-AgCl). More preferably, it is controlled to be at an oxidation-reduction potential of 0.55 to 0.7 V (vs. Ag-AgCl). When the oxidation-reduction potential of the acidic cleaning aqueous solution exceeds 0.8 V (vs. Ag-AgCl), harmful bromide gas will be produced as described above. On the contrary, when the oxidation-reduction potential is less than 0.5 V (vs. Ag-AgCl), the etching amount is deficient, and the de-smutting ability is lowered. The term, Ag-AgCl abbreviatedly designates the silver-silver chloride electrode.

When performing cleaning of aluminum or aluminum alloy with the solution which contains ferric ions as oxidized metal, however, the ferric ions are changed into ferrous ions with the lapse of time based on $Fe^{3+}+e \rightarrow Fe^{2+}$, which will lead to reduction in the oxidation-reduction potential at any time (referred to also as aging of cleaning bath) and no etching accelerating effect on the aluminum surfaces.

When continuing to newly supply ferric ions ($Fe^{3+}$) in order to control the oxidation-reduction potential (ORP), the ferrous ions ($Fe^{2+}$) are accumulated within the acidic cleaning bath, as the result of which the acidic cleaning bath becomes muddy, and the precipitation derived from the ferrous ions is produced, thus deteriorating the treatment workability. The objects to be treated such as aluminum cans taken out of the acidic cleaning bath carry the ferric ions to the subsequent process steps, which may cause precipitation in the subsequent process steps and adversely affect the chemical-conversion coating.

Thus, in order to control the ORP, the above-mentioned "oxidized metal ions and oxidizing agent" or "oxidizing agent" are supplied so as to hold the ORP within the above range, whereby the above problems will be solved.

The process of acidic cleaning of aluminum surfaces of the present invention can employ either spray method or immersion method. For the execution of acidic cleaning, the treatment temperature is preferably 35° to 80° C. More specifically, in the case of using the bromide ions as the etching accelerator, the temperature to be applied is more preferably changed based on the concentration of bromide ions ($Br^-$). More preferable temperatures are 60° to 80° C., and 35° to 60° C. when $Br^-$ is 0.05 to 0.5 g/l and 0.5 to 5 g/l, respectively. Namely, deficient etching due to a lower temperature is compensated for by bromide ions at a lower temperature range (35° to 60°), and the balance is kept at a higher temperature range (60° to 80° C.) by reducing the content of the oxidized metal ions (for example, ferric ions and/or metavanadic ions). If the treatment temperature exceeds 80° C., the aging of the treatment bath due to excessive etching is accelerated. If it is less than 35° C., the etching amount is deficient, and the de-smutting ability is reduced.

The treatment time for acidic cleaning is preferably 30 to 300 seconds. The treatment time exceeding 300 seconds will lead to excessive etching and accelerate the aging of the treatment bath. The treatment time of less than 30 seconds will lead to a deficient etching amount and reduced de-smutting ability. More preferably, the treatment time is 45 to 120 seconds.

The aluminum surfaces which have been cleaned by the acidic cleaning aqueous solution may be subjected to the phosphate chemical-conversion coating after water-washing in the conventional manner.

According to the present invention, the reactions shown by the following reaction formulae can be accelerated.

$Al \rightarrow Al^{3+}+3e$ (anode)

$Ox+ne \rightarrow Red$ (cathode)

In the acidic aqueous solution, $2H^{+}+2e \rightarrow H_2$ (cathode)

The etching reaction on the aluminum surfaces occurs as in the above reaction formulae. Therefore, by using both bromide ions serving as an "anode depolarizer" for accelerating anode reaction and oxidized metal ions serving as a "cathode depolarizer" for accelerating cathode reaction, the etching on the aluminum surfaces is accelerated.

Also, by controlling the oxidation-reduction potential of the cleaning bath at 0.5 to 0.8 V (vs. Ag-AgCl), the above reaction can be accelerated without producing bromine gas.

Furthermore, by appropriately adding within the cleaning bath ferric ions as the "oxidized metal ions" and hydrogen peroxide as an "oxidizing agent" for the control of ORP, the oxidation-reduction potential of the cleaning bath can be controlled at 0.5 to 0.8 V (vs. Ag-AgCl) without rendering he cleaning bath muddy.

The use of bromide ions as an "anode depolarizer" prevents pits from being produced on the aluminum surfaces after cleaning as in the case of using chloride ions. This is due to the fact that bromide ions have a larger ion radius than chloride ions, which makes it difficult for them to pass through the aluminum oxide layer.

Moreover, the oxidation and decomposition reaction of the surfactant by the oxidized metal ions and oxidizing agent is suppressed by a minute amount of bromide ions, so that oxidation-decomposition products are accumulated within the cleaning bath, thereby preventing the degreasing ability on the aluminum surfaces from being reduced. This ensures a satisfactory cleaning of the aluminum surfaces.

According to the present invention in the case of including no ferric ions, the use of an acid in cleaning aqueous solution does not cause a precipatate derived from iron, which eases the maintenance of the cleaning bath and ensures the satisfactory cleaning of the aluminum surfaces.

The present invention will be described in detail but non-limitatively by the following actual examples and comparison examples.

ACTUAL EXAMPLES 1–22 AND COMPARISON EXAMPLES 1–6

(1) Objects to be Treated:

Lidless containers with lubricating oil and smut adhering, obtained by DI process of 3004 alloy aluminum plate.

(2) Cleaner:

The cleaner was prepared by mixing 75% sulfuric acid, 20% aqueous solution of $Fe_2(SO_4)_3$ and 67.5% nitric acid with addition of 47% aqueous solution of HBr or 95% NaBr as a bromide ion supply source, and 95% $NaVO_3$ as a $VO_3^-$ ion supply source. Respective compositions are as described in actual Examples and comparison Examples shown in Tables 1 to 4. In the Examples shown in Tables 1 and 3 a surfactant is added including a hydrocarbon derivative (HLB:6.7, 1 g/l) and an abietic acid derivative (HLB:13.8, 1 g/l). On the contrary, the above-described surfactant is not added in the Examples shown in Tables 2 and 4.

(3) Treatment Conditions:

The above containers were spray-treated for 60 sec. at predetermined temperatures shown in Tables with the various cleaners, then spray-washed for 15 sec with tap water and then for 5 sec. with deionized water, after which they were dried at 95° C.

(4) Cleaning Power Evaluation:

The following items were tested. The results are shown in Tables 1 to 4.

(a) External appearance:

The whiteness of the interior surface of the container after drying was judged visually. The case in which degreasing and de-smutting were complete and a fully etched white external appearance was shown is rated as good; and evaluation was made based on the 5 grades given below according to the degree of whitening.

◎: whole surface whitened

○: partially light gray

Δ: whole surface light gray x: partially gray xx: whole surface gray (b) Water wettability:

Immediately after the water spray washing, the container was shaken 3 times to remove the water, after which the container was set down upright, after 30 sec. the outer surface area of the container wetted with water(%) was measured.

(c) De-smutting ability:

Transparent adhesive tape was stuck to the inner surface of the container after drying, and it was then pulled off and stuck to white cardboard. The whiteness of the surface with the tape stuck to it was compared to the other part of the white cardboard. The case in which the smut was completely removed and the surface had no contamination was considered good, and evaluation was made based on the 5 grades given below according to the degree of contamination.

5: no contamination

4: traces of contamination

3: very minute contamination

2: moderate contamination

1: great contamination

The following are the results of evaluation. The base for acidic washing bath was prepared by mixing 10g/l of 75% sulfuric acid and 1g/l of 67.5% nitric acid. "ORP" in the tables designates an oxidation-reduction potential in the bath (silver-silver chloride electrode potential reference, vs. Ag-AgCl).

TABLE 1

| | | | | Case of Adding Surfactant | | | |
|---|---|---|---|---|---|---|---|
| | $Br^-$ (g/l) | $Fr^{3+}$ (g/l) | Treatment Temperature (°C.) | External Appearance | Water Wettability | De-smutting Ability | OPR (vs. Ag—AgCl) (mV) |
| Actual Example | | | | | | | |
| 1 | 1.0 | 1.0 | 50 | ◎ | 100 | 5 | 765 |
| 2 | 1.0 | 2.0 | 40 | ◎ | 100 | 5 | 782 |
| 3 | 0.5 | 3.0 | 50 | ◎ | 100 | 5 | 770 |
| 4 | 2.0 | 1.0 | 50 | ◎ | 100 | 5 | 755 |
| 5 | 1.0 | 1.0 | 40 | ◎ | 100 | 5 | 753 |
| 6 | 4.5 | 1.0 | 50 | ◎ | 100 | 5 | 750 |
| 7 | 1.0 | 3.8 | 40 | ◎ | 100 | 5 | 804 |
| 8 | 0.1 | 0.2 | 70 | ◎ | 100 | 5 | 703 |
| 9 | 0.01 | 0.8 | 70 | ◎ | 100 | 5 | 628 |
| Reference Example | | | | | | | |
| 1 | $F^-$ 0.2 | — | 50 | ◎ | 100 | 5 | — |
| Comparison Example | | | | | | | |
| 1 | — | 1.0 | 70 | ◎ | 100 | 5 | 635 |
| 2 | $Cl^-$ 0.5 | 1.0 | 50 | Δ | 100 | 3 | 640 |
| 3 | — | 1.0 | 50 | X | 100 | 2 | 610 |

TABLE 2

| | Br⁻ (g/l) | $Fr^{3+}$ (g/l) | Treatment Temparature (°C.) | External Appearance | Water Wettability | De-smutting Ability | OPR (vs. Ag—AgCl) (mV) |
|---|---|---|---|---|---|---|---|
| | Case of Adding No Surfactant | | | | | | |
| Actual Example | | | | | | | |
| 10 | 1.0 | 1.0 | 50 | ○ | 80 | 4 | 765 |
| 11 | 1.0 | 2.0 | 40 | ○ | 80 | 4 | 782 |
| 12 | 0.5 | 3.0 | 50 | ○ | 85 | 4 | 770 |
| 13 | 2.0 | 1.0 | 50 | ○ | 80 | 4 | 755 |
| 14 | 1.0 | 1.0 | 40 | ○ | 80 | 4 | 753 |
| 15 | 4.5 | 1.0 | 50 | ○ | 80 | 4 | 750 |
| 16 | 1.0 | 3.8 | 40 | ○ | 80 | 4 | 804 |
| 17 | 0.1 | 0.2 | 70 | ○ | 85 | 4 | 703 |
| 18 | 0.01 | 0.8 | 70 | ○ | 85 | 4 | 628 |
| Reference Example | | | | | | | |
| 2 | $F^-$ 0.02 | — | 50 | ○ | 80 | 4 | — |
| Comparison Example | | | | | | | |
| 4 | — | 1.0 | 70 | ⊙ | 80 | 4 | 635 |
| 5 | $Cl^-$ 0.5 | 1.0 | 50 | Δ | 60 | 2 | 640 |
| 6 | — | 1.0 | 50 | X | 50 | 2 | 610 |

TABLE 3

| | Br⁻ (g/l) | $Fr^{3+}$ (g/l) | Treatment Temparature (°C.) | External Appearance | Water Wettability | De-smutting ability | OPR (vs. Ag—AgCl) (mV) |
|---|---|---|---|---|---|---|---|
| | Case of Adding Surfactant | | | | | | |
| Actual Example | | | | | | | |
| 19 | 1.0 | 1.0 | 50 | ⊙ | 100 | 5 | 791 |
| 20 | 1.0 | 2.0 | 40 | ⊙ | 100 | 5 | 802 |

TABLE 4

| | Br⁻ (g/l) | $Fr^{3+}$ (g/l) | Treatment Temparature (°C.) | External Appearance | Water Wettability | De-smutting ability | OPR (vs. Ag—AgCl) (mV) |
|---|---|---|---|---|---|---|---|
| | Case of Adding No Surfactant | | | | | | |
| Actual Example | | | | | | | |
| 21 | 1.0 | 1.0 | 50 | ○ | 85 | 4 | 791 |
| 22 | 1.0 | 2.0 | 40 | ○ | 80 | 4 | 802 |

According to these results, acidic cleaner for aluminum metal of the present invention ensures satisfactory cleaning at a lower temperature and without using any fluoride ions.

ACTUAL EXAMPLES 23 TO 40 AND COMPARISON EXAMPLES 7 TO 12

(1) Objects and Amounts to be Treated:

500 cans manufactured by DI process of aluminum plate and having a diameter of 6.6 cm and an internal volume of 350 ml were treated.

(2) Treatment Steps:

The treatment was sequentially made in the following order.

Pre-wash (40° C. ±2° C., 20 sec., spray pressure 1.0 $Kg/cm^2$)

Wash (50° C. ±2° C., 1 min., spray pressure 3.0 $Kg/cm^2$)

Rinse (25° C. to 35° C., 30 sec., spray pressure 0.5 $Kg/cm^2$)

Deionized water rinse (20° C. to 30°, 20 sec., spray pressure 0.5 $kg/cm^2$)

Drying (210° C. ±10° C., 2 min., hot blast)

(3) Main Cleaner:

A treatment bath (20 1) having the following compositions was made up and used.

bromide ion 1.0 g/l ferric ion 1.0 g/l sulfate ion 12.5 g/l nitrate ion 1.5 g/l nonionic surfactant 2.0 g/l (the same as example 1)

(4) Pre wash Cleaner:

About 10 wt. % of the above-described main cleaner was used. The nitrate ions, bromide ions and surfactant were appropriately supplied according to the consumption.

(5) Treatment Results:

Using the treatment bath at 20 1 for wash, the amounts of decrease in ORP and ferric ion after washing the 500 cans to be treated were measured. Furthermore, ORP of the treatment bath after adding the oxidizing agent was measured, and the external appearance of the cans washed within the treatment bath was observed. The washed cans in which a white satin state as in the external appearance of the cans which we cleaned in the bath at the time of manufacture was present and the smut and residual oil were completely removed was considered good. The evaluation of cleansing ability is substantially the same as the above.

TABLE 5

| | At Bath Making up | | | Type and Amounts to be Added of | | ORP Before and After Adding Oxidizing Agent (vs. Ag—AgCl) | | Treatment Appearance at | |
|---|---|---|---|---|---|---|---|---|---|
| | Ferric | | | Oxidizing Agent for | | (mV) | | Bath Building | |
| Actual Examples | Ion (g/l) | $Br^-$ (g/l) | At Aging (g/l) | ORP Control (g/l) | | Before Addition | After Addition | or After Adding Oxidizing Agent | Temparature (°C.) |
| 23 | 1.0 | 1.0 | — | — | | 765 | — | ◎ | 50 |
| 24 | 1.0 | 1.0 | $Fe^{3+}$:0.26 $Fe^{2+}$:0.69 | $H_2O_2$ 0.5 | | 492 | 715 | ◎ | 50 |
| 25 | 1.0 | 1.0 | " | $H_2O_2$ | 0.4 | 492 | 681 | ◎ | 50 |
| 26 | 1.0 | 1.0 | " | $H_2O_2$ | 0.3 | 492 | 673 | ◎ | 50 |
| 27 | 1.0 | 1.0 | " | $H_2O_2$ | 0.2 | 492 | 659 | ◎ | 50 |
| 28 | 1.0 | 1.0 | " | $H_2O_2$ | 0.1 | 492 | 572 | ○ | 50 |
| 29 | 1.0 | 1.0 | " | $NaVO_3$ | 1.5 | 492 | 692 | ◎ | 50 |
| 30 | 1.0 | 1.0 | " | $NaVO_3$ | 0.7 | 492 | 615 | ○ | 50 |
| 31 | 1.0 | 1.0 | " | $NaNO_2$ | 0.9 | 492 | 679 | ◎ | 50 |
| 32 | 1.0 | 1.0 | " | $NaNO_2$ | 0.4 | 492 | 602 | ○ | 50 |
| 33 | 1.0 | 1.0 | " | $Na_2S_2O_8$ 3.0 | | 492 | 699 | ◎ | 50 |
| 34 | 1.0 | 1.0 | " | $Na_2S_2O_8$ 4.0 | | 492 | 831 | ○ | 50 |
| 35 | 1.0 | 1.0 | " | $Na_2S_2O_8$ 1.5 | | 492 | 607 | ○ | 50 |
| 36 | 1.0 | 1.0 | " | (NH4)4Ce(SO4)4 7.2 | | 492 | 695 | ◎ | 50 |
| 37 | 1.0 | 1.0 | " | " | 9.0 | 492 | 825 | ○ | 50 |
| 38 | 1.0 | 1.0 | " | " | 3.5 | 492 | 618 | ○ | 50 |
| 39 | 0.8 | 0.01 | $Fe^{3+}$:0.19 $Fe^{2+}$:0.60 | $H_2O_2$ 0.3 | | 485 | 640 | ◎ | 70 |
| 40 | 0.2 | 0.1 | $Fe^{3+}$:0.05 $Fe^{2+}$:0.13 | $H_2O_2$ 0.1 | | 501 | 710 | ◎ | 70 |

TABLE 6

| | At Bath Making up | | | Type and Amounts to be Added of | | ORP Before and After Adding Oxidizing Agent (vs. Ag—AgCl) (mV) | | Treatment Appearance at Bath making up | |
|---|---|---|---|---|---|---|---|---|---|
| | Ferric Ion (g/l) | $Br^-$ (g/l) | At Aging (g/l) | Oxidizing Agent for ORP Control (g/l) | | Before Addition | After Addition | or After Adding Oxidizing Agent | Temparature (°C.) |
| Comparison Examples | | | | | | | | | |
| 7 | 1.0 | 1.0 | $Fe^{3+}$:0.26 $Fe^{2+}$:0.69 | — | 0 | 492 | — | X | 50 |
| 8 | " 1.0 | 1.0 | " | $H_2O_2$ | 0.01 | 492 | 498 | Δ | 50 |
| 9 | " 1.0 | 0 | — | — | | 635 | — | ◎ | 70 |
| 10 | " 1.0 | 0 | $Fe^{3+}$0.21 $Fe^{2+}$0.72 | $H_2O_2$ | 1.2 | 465 | 643 | ◎ | 70 |
| 11 | " 1.0 | 0 | — | $H_2O_2$ | 0.4 | 465 | 491 | X | 70 |
| 12 | " 1.0 | 0 | — | $H_2O_2$ | 1.2 | 458 | 637 | X | 50 |

As shown in Tables 5 and 6, the treatment bath immediately after makeing up building (Example 23) presents a higher ORP value and better appearance after treatment. However, the treatment bath (Comparison Example 7) presented a decreased concentration of ferric ions and reduced ORP value, which leads to a poor external appearance. Therefore, an oxidizing agent for ORP control is added to this treatment bath to oxidize ferrous ions accumulated within the treatment bath into ferric ions so as to restore the ORP value to its initial state, thus again obtaining a good treatment appearance.

Examples 24 to 28, 39, and 40 show the results of adding hydrogen peroxide as the oxidizing agent for ORP control, which all presented the increased ORP value and good treatment external appearance. However, if there is little hydrogen peroxide to be added, the ORP value is not fully raised, which deteriorates the treatment external appearance as shown in Comparison Example 8.

The Examples 29 to 38 used metavanadic ions, nitrite ions, persulfate ions, cerimetric ions in addition to the hydrogen peroxide as the oxidizing agent for ORP control, as described earlier. It is to be noted that if a great amount of oxidizing agent for ORP control is added (Example 34, 37) the ORP approaches the upper limit (0.8 V), which may cause a risk of production of bromine gas. A slight occurrence of pitting on the aluminum surface due to excess etching may slightly deteriorate the treatment appearance compared with the other examples. From these results, it is necessary for the ORP value of the cleaning bath to be controlled within the range of 0.5 to 0.8 V(vs. Ag-AgCl), more preferably, 0.55 to 0.7 V (vs. Ag-AgCl).

Comparison Example 12, which was treated at a lower temperature than Comparison Example 10, presents a poor treatment external appearance due to insufficient treatment.

ACTUAL EXAMPLES 41–55 AND CONTROL EXAMPLES 13–21

(1) Objects to be Treated:

Lidless containers with lubricating oil and smut adhering thereto, obtained by DI process of 3004 alloy aluminum plate.

(2) Cleaner:

An acidic cleaner for use in "(4) Oxidation Efficiency Evaluation", that is, an acidic cleaner after oxidizing ferrous ions within the cleaner into ferric ions, was used.

(3) Treatment Conditions:

The above-described containers were spray-treated for 60 sec. at 40° to 50° C. with the various cleaners, then spray-washed for 15 sec. with tap water and then for 5 sec. with deionized water, after which they were dried at 95° C.

(4) Oxidation Efficiency Evaluation:

An acidic cleaner with compositions described in Actual Examples and Control Examples shown in Tables 7, 8 and 9 below was heated to 70° C. while being stirred with the dripping of hydrogen peroxide. At the time of oxidizing all ferrous ions ($Fe^{2+}$) into ferric ions($Fe^{3+}$), the oxidation efficiency was calculated based on the following expression where a is the amount of hydrogen peroxide theoretically required, and b is the amount required for the execution.

Oxidation efficiency=(a/b)×100(%)

◎:80 to 100(%)

○: 60 to 80(%)

○~Δ: 40 to 60(%)

Δ: 20 to 40(%)

x: 0 to 20(%)

(5) Cleaning Power Evaluation:

The following items were tested. The results are shown in Tables 7, 8 and 9. The external appearance, water wettability, and de-smutting ability conform to the evaluation criteria used in the evaluation of the above-described Actual Examples 41 to 55 and Comparison Examples 13 to 21.

The evaluation results are shown below. "ORP" in the tables designates the oxidation-reduction potential in the bath (silver-silver chloride electrode potential reference, vs. Ag-AgCl).

TABLE 7

FERROUS ION ($Fe^{2+}$) CONCENTRATION IN AGED acidic CLEANER: 0.2 g/l
Inorganic acid; $H_2SO_4$: 10 g/l
Surfactant; nonionic surfactant:
(1) Nonylphenol EO additive: 1.0 g/l HLB: 13.2
(2) Hydrocarbon derivative: 1.0 g/l HLB: 6.7

| | Additives for Inhibiting Oxidation - Decomposition Reaction | | Oxidation | | Water | | |
|---|---|---|---|---|---|---|---|
| | Additives | Additive Concentration (g/l) | Efficiency Judgement | External Appearance | Wettability (%) | De-smutting Ability | Temparature (°C.) |
| Actual Examples | | | | | | | |
| 41 | Bromide Ion ($Br^-$) | 0.002 | Δ | ◎ | 100 | 5 | 75 |
| 42 | Bromide Ion ($Br^-$) | 0.005 | Δ~○ | ◎ | 100 | 5 | 75 |
| 43 | Bromide Ion ($Br^-$) | 0.01 | ○ | ◎ | 100 | 5 | 75 |
| 44 | Bromide Ion ($Br^-$) | 0.02 | ○ | ◎ | 100 | 5 | 75 |
| 45 | Bromide Ion ($Br^-$) | 0.04 | ◎ | ◎ | 100 | 5 | 75 |
| 46 | Bromide Ion ($Br^-$) | 0.4 | ◎ | ◎ | 100 | 5 | 75 |
| Comparison Examples | | | | | | | |
| 13 | No | — | Δ | ○ | 80 | 4 | 75 |
| 14 | Diethylene Glycol | 1.0 | ○ | ◎ | 100 | 5 | 75 |
| 15 | Diethylene Glycol | 0.04 | Δ | ◎ | 100 | 5 | 75 |
| 16 | Chloride Iron ($Cl^-$) | 0.18 | Δ~○ | Δ | 80 | 4 | 75 |
| 17 | Iodide Ion ($I^-$) | 0.635 | X | ◎ | 80 | 4 | 75 |

TABLE 8

FERROUS ION ($Fe^{2+}$) CONCENTRATION IN AGED acidic CLEANER: 0.1 g/l
Inorganic acid; $H_2SO_4$: 10 g/l
Surfactant; nonionic surfactant:
(1) Nonylphenol EO additive: 1.0 g/l HLB: 13.2
(2) Hydrocarbon derivative: 1.0 g/l HLB: 6.7

| | Additives for Inhibiting Oxidation - Decomposition Reaction | | Oxidation | | Water | | |
|---|---|---|---|---|---|---|---|
| | Additives | Additive Concentration (g/l) | Efficiency Judgement | External Appearance | Wettability (%) | De-smutting Ability | Temparature (°C.) |
| Actual Examples | | | | | | | |
| 47 | Bromide Ion ($Br^-$) | 0.005 | Δ | ◎ | 100 | 5 | 70 |
| 48 | Bromide Ion ($Br^-$) | 0.02 | ○ | ◎ | 100 | 5 | 70 |
| 49 | Bromide Ion ($Br^-$) | 0.04 | ○ | ◎ | 100 | 5 | 70 |
| 50 | Bromide Ion ($Br^-$) | 0.2 | ◎ | ◎ | 100 | 5 | 65 |
| 51 | Bromide Ion ($Br^-$) | 0.4 | ◎ | ◎ | 100 | 5 | 60 |
| 52 | Bromide Ion ($Br^-$) | 0.8 | ◎ | ◎ | 100 | 5 | 50 |
| Comparison Examples | | | | | | | |
| 18 | No | — | X | ○ | 80 | 3 | 70 |
| 19 | Diethylene Glycol | 1.0 | Δ | ◎ | 100 | 5 | 70 |

TABLE 8-continued

FERROUS ION ($Fe^{2+}$) CONCENTRATION IN AGED acidic CLEANER: 0.1 g/l
Inorganic acid; $H_2SO_4$: 10 g/l
Surfactant; nonionic surfactant:
(1) Nonylphenol EO additive: 1.0 g/l HLB: 13.2
(2) Hydrocarbon derivative: 1.0 g/l HLB: 6.7

| | Additives for Inhibiting Oxidation - Decomposition Reaction | | Oxidation | | Water | | |
|---|---|---|---|---|---|---|---|
| | Additives | Additive Concentration (g/l) | Efficiency Judgement | External Appearance | Wettability (%) | De-smutting Ability | Temparature (°C.) |
| 20 | Diethylene Glycol | 0.04 | X | ○ | 80 | 3 | 70 |
| 21 | Diethylene Glycol | 1.0 | Δ | X | 80 | 3 | 50 |

TABLE 9

FERROUS ION ($Fe^{2+}$) CONCENTRATION IN AGED acidic CLEANER; 1.0 g/l
inorganic acid; $H_2SO_4$: 10 g/l

| | Inorganic Acid | | Additives for Inhibiting Oxidation-Decomposition Reaction | | | | | | | | |
|---|---|---|---|---|---|---|---|---|---|---|---|
| | | | | Additive | Surfactant | | Oxidation | External | Water | De-sum-ut-ting | Tempa- |
| Actual Examples | $H_2SO_4$ (g/l) | $HNO_3$ (g/l) | Additives | Concentration (g/l) | Type | Amount (g/l) | Efficienty Judgement | Appea-rance | Wett-ability | Abil-ity | rature (°C.) |
| 53 | 10.0 | 1.0 | Bromide Ion ($Br^-$) | 0.04 | ①*1<br>②*2 | 1.0<br>1.0 | ◎ | ◎ | 100 | 5 | 65 |
| 54 | 10.0 | 1.0 | Bromide Ion ($Br^-$) | 0.04 | ①<br>② | 0.25<br>0.25 | ◎ | ◎ | 85 | 5 | 65 |
| 55 | 4.0 | 1.0 | Bromide Ion ($Br^-$) | 0.04 | ①<br>② | 1.0<br>1.0 | ◎ | ◎ | 100 | 5 | 70 |

note
*1Nonylphenol EO additive (1) HLB: 13.2
*2Hydrocarbon derivative (2) HLB 6.7

Variations in abilities based on ORP values are shown in Actual Examples 56 to 58. In conformity with the Actual Example 41, the abilities were evaluated with the addition of $H_2O_2$ where the ORP values of the solutions having the above-described compositions are 0.60, 0.50, 0.45 V (vs. Ag-AgCl), respectively. The results are shown in Table 10.

TABLE 10

FERROUS ION ($Fe^{2+}$) CONCENTRATION IN AGED acidic CLEANER; 1.0 g/l
Inorganic acid; $H_2SO_4$: 10 g/l
Surfactant; nonionic surfactant; Nonylphenol EO additive:
1.0 g/l (HLB:13.2) and Hydrocarbon derivative: 1.0 g/l (HLB:6.7)

| | Additives for Inhibiting Oxidation - Decomposition Reaction | | ORP | | Water | | |
|---|---|---|---|---|---|---|---|
| Actual Examples | Additives | Additive Concentration (g/l) | (vs. Ag—AgCl) (V) | External Appearance | Wettability (%) | De-smutting Ability | Temparature (°C.) |
| 56 | Bromide Ion | | 0.60 | ◎ | 100 | 5 | 70 |
| | ($Br^-$) | 0.005 | 0.50 | ○ | 100 | 4 | 70 |
| | | | 0.45 | Δ | 100 | 3 | 70 |
| 57 | Bromide Ion | | 0.60 | ◎ | 100 | 5 | 60 |
| | ($Br^-$) | 0.04 | 0.50 | ○ | 100 | 4 | 60 |
| | | | 0.45 | X | 100 | 2 | 60 |
| 58 | Bromide Ion | | 0.60 | ◎ | 100 | 5 | 50 |
| | ($Br^-$) | 2.0 | 0.50 | ○ | 100 | 4 | 50 |
| | | | 0.45 | X | 100 | 2 | 50 |

note)
*1Oxidation-reduction potential

From these results, it can be seen that the acidic cleaner for aluminum metal of the present invention ensures satisfactory cleaning without using fluoride ions.

ACTUAL EXAMPLES 56–70 AND COMPARISON EXAMPLES 22–24

(1) Objects to be Treated:

Lidless containers with lubricating oil and smut adhering, obtained by DI process of 3004 alloy aluminum plate.

(2) Cleaner:

The cleaner was prepared by mixing 75% sulfuric acid and 67.5% nitric acid with the addition of a 47% aqueous solution of HBr or 95% NaBr as a bromide ion supply source and nonionic surfactant. Respective compositions are as described in actual examples and comparison Examples shown in Tables 11.

(3) Treatment Conditions:

The above containers were spray-treated for 60 sec. at 70° C. with the various cleaners, then spray-washed for 15 sec with tap water and then for 5 sec. with deionized water, after which they were dried at 95° C.

(4) Cleaning Power Evaluation:

The external appearance, water wettability, and de-smutting ability were tested in the same manner as Actual Example 1, and resistance to pitting was tested by the following method. The results are shown in Tables 11.

Resistance to pitting:

A test piece is brought into contact with the stainless steel plate and immersed for 5 min. at 70° C. within a test liquid including liquid compositions for each Example and 600 ppm of hydrochloride acid (HCl) added thereto, to observe the surface in the vicinity of the contact portion. Evaluation was made based on the 5 grades below according to the generation of pits.

◎: no pits observed

○: a few minute pits observed

Δ: a multiplicity of minute pits observed x : a few large pits observed xx: a multiplicity of large pits observed The evaluation results are shown below.

TABLE 11

| | Inorganic Acid | | | Nonionic Surfactant | | | | | | Treatment Temperature | External Appearance | Water Wettability | De-smutting Ability | Resistance to Pitting |
|---|---|---|---|---|---|---|---|---|---|---|---|---|---|---|
| | $H_2SO_4$ (g/l) | $HNO_3$ (g/l) | $Br^-$ (g/l) | Type | (g/l) | HLB | Type | (g/l) | HLB | (°C.) | | (%) | | |
| Actual Examples | | | | | | | | | | | | | | |
| 56 | 15 | — | 0.5 | ①*1 | 1.0 | 13.3 | ②*2 | 1.0 | 5.8 | 70 | ◎ | 100 | 5 | ○ |
| 57 | 10 | — | 0.5 | ① | 1.0 | 13.3 | ② | 1.0 | 5.8 | 70 | ◎ | 100 | 5 | ○ |
| 58 | 15 | — | 2.0 | ③*3 | 1.0 | 13.7 | ④*4 | 1.0 | 6.7 | 60 | ◎ | 100 | 5 | ○ |
| 59 | 15 | 1.0 | 0.5 | ③ | 1.0 | 13.7 | ④ | 1.0 | 6.7 | 70 | ◎ | 100 | 5 | ◎ |
| 60 | 15 | 1.0 | 1.0 | ① | 1.0 | 13.3 | ② | 1.0 | 5.8 | 60 | ◎ | 100 | 5 | ◎ |
| 61 | 15 | — | 1.0 | ③ | 1.0 | 13.7 | ④ | 1.0 | 6.7 | 50 | Δ~○ | 100 | 4 | ○ |
| 62 | 15 | 1.0 | 1.0 | ③ | 1.0 | 13.7 | ④ | 1.0 | 6.7 | 80 | ◎ | 100 | 5 | ◎ |
| 63 | 0.5 | — | 1.0 | ① | 1.0 | 13.3 | ② | 1.0 | 5.8 | 70 | ○ | 100 | 4 | ◎ |
| 64 | 25 | — | 1.0 | ① | 1.0 | 13.3 | ② | 1.0 | 5.8 | 50 | ○ | 100 | 4 | ◎ |
| 65 | 15 | 1.0 | 0.1 | ③ | 1.0 | 13.7 | ④ | 1.0 | 6.7 | 70 | ○ | 100 | 4 | ◎ |
| 66 | 15 | 0.5 | 5.0 | ③ | 1.0 | 13.7 | ④ | 1.0 | 6.7 | 70 | ◎ | 100 | 5 | ○ |
| 67 | 15 | 1.0 | 0.5 | ① | 0.25 | 13.3 | ② | 0.25 | 5.8 | 70 | ◎ | 100 | 5 | ◎ |
| 68 | 15 | 1.0 | 0.5 | ① | 2.5 | 13.3 | ② | 2.5 | 5.8 | 70 | ◎ | 100 | 5 | ◎ |
| 69 | 15 | 1.0 | 0.5 | ① | 5.0 | 13.3 | ② | 5.0 | 5.8 | 70 | ◎ | 100 | 5 | ◎ |
| 70 | 15 | 1.0 | 0.5 | ① | 0.05 | 13.3 | ② | 0.05 | 5.8 | 70 | ○ | 98 | 4 | ◎ |
| Comparions Examples | | | | | | | | | | | | | | |
| 22 | 0.2 | — | 1.0 | ① | 1.0 | 13.3 | ② | 1.0 | 5.8 | 70 | Δ | 80 | 2 | ◎ |
| 23 | 15 | 1.0 | 1.0 | — | — | — | — | — | — | 70 | Δ | 0 | 1 | ◎ |
| 24 | 15 | — | — | ① | 1.0 | 13.3 | ② | 1.0 | 5.8 | 70 | Δ | 90 | 3 | ◎ |

note)
*1alkylphenol EO additive nonionic surfactant (1)
*2hydrocarbon derivative nonionic surfactant (2)
*3primary ethoxylation alcohol type nonionic surfactant (3)
*4Modified polyethoxylation alcohol type nonionic surfactant (4)

From these results, it can be seen that the acidic cleaner for aluminum metal of the present invention ensures satisfactory cleaning without using fluoride ions.

According to the acidic cleaner for aluminum metal and its cleaning method of the present invention described above, lubricant oil and smut adhering to the aluminum surface can be removed without using harmful chromic ions and fluoride ions which may cause pollution and pollute the working environment and the consumption of the oxidizing agent and surfactant can be suppressed, thereby accomplishing purification ensuring a smooth chemical-conversion coating and coating operation.

What is claimed is:

1. An acidic cleaning aqueous solution for aluminum and aluminum alloy which comprises:

(a) 0.5 to 25 g/l of at least one inorganic acid;

(b) 0.002 to 5 g/l of bromide ions; and (c) 0.05 to 4 g/l of oxidized metallic ions;

(d) 0.1 to 10 g/l of surfactant, and an oxidizing agent, further wherein said at least one inorganic acid is an inorganic acid mixture consisting of sulfuric acid and nitric acid having a mixture weight ratio of sulfuric acid/nitric acid of 30/1 to 30/4.

2. An acidic cleaning aqueous solution for aluminum and aluminum alloy according to claim 1, wherein said inorganic acid contained within said acidic cleaning aqueous solution is 10 to 25 g/l.

3. An acidic cleaning aqueous solution for aluminum and aluminum alloy according to claim 1, wherein said acidic cleaning aqueous solution for aluminum and aluminum alloy consists of:

(a) 10 to 25 g/l of at least one inorganic acid; (b) 0.01 to 0.08 g/l of bromide ions when mainly aiming at inhibiting the oxidation-decomposition reaction of the surfactant; (c) 0.2 to 2 g/l of oxidized metallic ion; and (d) 0.5 to 2 g/l of nonionic surfactant.

4. An acidic cleaning aqueous solution for aluminum and aluminum alloy according to claim 1, wherein when mainly aiming at inhibiting the oxidation-decomposition reaction of surfactant, the content of bromide ions within the acidic cleaning aqueous solution is 0.01 to 0.08 g/l.

5. An acidic cleaning aqueous solution for aluminum and aluminum alloy according to claim 1, wherein when mainly aiming at inhibiting the oxidation-decomposition reaction of surfactant, the content of bromide ions within the acidic cleaning aqueous solution is 0.002 to 0.03 g/l at a treatment temperature of 35° to 60°C.

6. An acidic cleaning aqueous solution for aluminum and aluminum alloy according to claim 1, wherein when mainly aiming at inhibiting the oxidation-decomposition reaction of surfactant, the content of bromide ions within the acidic cleaning aqueous solution is 0.03 to 0.1 g/l at a treatment temperature of 60° to 80° C.

7. An acidic cleaning aqueous solution for aluminum and aluminum alloy according to claim 1, wherein said acidic cleaning aqueous solution for aluminum and aluminum alloy consists of:

(a) 10 to 25 g/l of at least one inorganic acid;

(b) 0.1 to 2.5 g/l of bromide ions when mainly aiming at accelerating etching;

(c) 0.2 to 2 g/l of oxidized metallic ions; and (d) 0.5 to 2 g/l of nonionic surfactant.

8. An acidic cleaning aqueous solution for aluminum and aluminum alloy according to claim 7, wherein the ORP value of said acidic cleaning aqueous solution for aluminum and aluminum alloy is 0.5 to 0.8 V (silver-silver choloride electrode potential reference).

9. An acidic cleaning aqueous solution for aluminum and aluminum alloy which comprises:

(a) 10 to 20 g/l of inorganic acid mixture consisting of sulfuric acid and nitric acidic and having a mixture weight ratio of sulfuric acid/nitric acidic of 30/1 to 30/4;

(b) 0.8 to 2.5 g/l of bromide ions; and (c) 1 to 5 g/l of nonionic surfactant.

10. An acidic cleaning aqueous solution for aluminum and aluminum alloy which comprises:

(a) 0.5 to 25 g/l of at least one inorganic acid;

(b) 0.002 to 5 g/l of bromide ions; and (c) 0.05 to 4 g/l of oxidized metallic ions;

wherein a supply source of the oxidized metal ions is at least one of ferric ions ($Fe^{3+}$), metavanadic ions ($VO^{3-}$), and cerimetric ions ($Ce^{4+}$) .

11. An acidic cleaning aqueous solution for aluminum and aluminum alloy according to claim 10, wherein the amount of said inorganic acid contained within said acidic cleaning solution is 10 to 25 g/l.

12. An acidic cleaning aqueous solution for aluminum and aluminum alloy according to claim 10, when mainly aiming to accelerating etching, the content of bromide ions the acidic cleaning aqueous solution is 0.1 to 2.5 g/l.

13. An acidic cleaning aqueous solution for aluminum and aluminum alloy according to claim 10, wherein the content of oxidized metal ions in the acidic cleaning aqueous solution is 0.2 to 2 g/l.

14. An acidic cleaning aqueous solution for aluminum and aluminum alloy which comprises:

(a) 0.5 to 25 g/l of at least one inorganic acid;

(b) 0.002 to 5 g/l of bromide ions; and (c) 0.05 to 4 g/l of oxidized metallic ions;

wherein said inorganic acid is an inorganic acid mixture consisting of sulfuric acid and nitric acid and having a mixture weight ratio of sulfuric acid/nitric acid of 30/1 to 30/4.

15. An acidic cleaning aqueous solution for aluminum and aluminum alloy according to claim 14, wherein the content of oxidized metal ions is 0.5 to 4.0 g/l at a treatment temperature of 35° to 60° C.

16. An acidic cleaning aqueous solution for aluminum and aluminum alloy according to claim 14, wherein when mainly aiming at accelerating etching, the content of bromide ions within the acidic cleaning aqueous solution is 0.1 to 2.5 g/l.

17. An acidic cleaning aqueous solution for aluminum and aluminum alloy according to claim 14, wherein a supply source of the oxidized metal ions is at least one of ferric ions ($Fe^{3+}$), metavanadic ions ($VO^{3-}$), and cerimetric ions ($Ce^{4+}$).

18. An acidic cleaning aqueous solution for aluminum and aluminum alloy according to claim 17, wherein a supply source of said metavanadic ions is at least one water-soluble metavanadic salt from among sodium metavanadate, potassium metavanadate, and ammonium metavanadate.

19. An acidic cleaning aqueous solution for aluminum and aluminum alloy according to claim 14, wherein a supply source of said ferric ions is at least one water-soluble ferric salt from among ferric sulfate, ferric nitrate, and ferric perchlorate.

20. An acidic cleaning aqueous solution for aluminum and aluminum alloy according to claim 14, wherein a supply source for bromide ions is at least one selected from the group consisting of HBr aqueous solution, potassium bromide, sodium bromide, aluminum bromide, and iron bromide.

21. An acidic cleaning aqueous solution for aluminum and aluminum alloy according to claim 14, wherein the content of oxidized metal ions is 0.05 to 4 g/l at a treatment temperature of 60° to 80° C.

22. An acidic cleaning aqueous solution for aluminum and aluminum alloy according to claim 14, wherein the content of oxidized metal ions within the acidic cleaning aqueous solution is 0.2 to 2 g/l.

23. An acidic cleaning aqueous solution for aluminum and aluminum alloy according to claim 14, wherein when mainly aiming at accelerating etching, the content of bromide ions within the acidic cleaning aqueous solution is 0.5 to 5 g/l at a treatment temperature of 35° to 60° C.

24. An acidic cleaning aqueous solution for aluminum and aluminum alloy according to claim 14, wherein said inorganic acid contained within said acidic cleaning aqueous solution is 10 to 25 g/l.

25. An acidic cleaning aqueous solution for aluminum and aluminum alloy according to claim 14, wherein when mainly aiming at accelerating etching, the content of bromide ions within the acidic cleaning aqueous solution is 0.05 to 0.5 g/l at a treatment temperature of 60° to 80° C.

26. An acidic cleaning aqueous solution for aluminum and aluminum alloy according to claim 1, wherein said surfactant is a nonionic surfactant.

27. An acidic cleaning aqueous solution for aluminum and aluminum alloy according to claim 1, wherein when mainly aiming at inhibiting the oxidation-decomposition reaction of surfactant, the content of bromic ions within the acidic cleaning aqueous solution is 0.01 to 0.08 g/l.

28. An acidic cleaning aqueous solution for aluminum and aluminum alloy according to claim 1, wherein the amount of said oxidizing agent to be added is so set that the oxidation-reduction potential value of the acidic cleaning aqueous solution for aluminum and aluminum alloy lies within the range of 0.5 to 0.8 V (silver-silver choloride potential reference).

29. An acidic cleaning aqueous solution for aluminum and aluminum alloy according to claim 1, wherein said oxidizing agent is at least one selected from the group of consisting of hydrogen peroxide, persulfate, ozone, and nitrite.

30. An acidic cleaning aqueous solution for aluminum and aluminum alloy according to claim 1, wherein the content of said surfactant within the acidic cleaning aqueous solution is 0.5 to 2 g/l.

* * * * *